United States Patent [19]

Churchill

[11] 4,125,761

[45] Nov. 14, 1978

[54] BILATERAL HEATER UNIT

[76] Inventor: John W. Churchill, 12 Winthrop Ave., Beverly, Mass. 01915

[21] Appl. No.: 712,262

[22] Filed: Aug. 6, 1976

Related U.S. Application Data

[63] Continuation-in-part of Ser. No. 513,140, Oct. 8, 1974, and Ser. No. 382,295, Jul. 25, 1973, Pat. No. 3,982,099.

[51] Int. Cl.[2] ..... H05B 3/44

[52] U.S. Cl. ..... 219/544; 219/552; 219/523; 219/541; 338/238; 338/240; 338/242

[58] Field of Search ..... 219/523, 528, 530, 540, 219/541, 542, 544, 549, 552; 338/139, 238, 239, 240, 241, 242, 274, 333, 60, 61, 62, 63, 174; 174/75 R, 84, 181

[56] References Cited

U.S. PATENT DOCUMENTS

| | | | |
|---|---|---|---|
| Re. 26,522 | 2/1969 | Fessenden | 219/528 |
| 1,731,119 | 10/1929 | Abbott et al. | 338/241 X |
| 1,903,142 | 3/1933 | Schellenger | 338/139 X |
| 1,948,354 | 2/1934 | Lodge | 338/139 X |
| 1,987,118 | 1/1935 | Lodge | 338/139 |
| 2,157,884 | 5/1939 | Backer | 338/242 X |
| 2,455,102 | 11/1948 | Temple | 338/242 X |
| 2,617,002 | 11/1952 | Hasley | 338/240 X |
| 2,734,759 | 11/1955 | Daniels | 338/174 X |
| 3,225,321 | 12/1965 | Walter | 338/274 |
| 3,286,082 | 11/1966 | Norton | 219/540 |
| 3,409,855 | 11/1968 | Bender et al. | 338/118 |
| 3,621,203 | 11/1971 | Geomini et al. | 219/528 |
| 3,646,322 | 2/1972 | Speckman | 219/549 |
| 3,750,081 | 7/1973 | Miller | 338/174 |
| 3,898,431 | 8/1975 | House et al. | 219/534 |
| 3,943,328 | 3/1976 | Cunningham | 219/335 |
| 3,982,099 | 9/1976 | Churchill | 219/544 |

FOREIGN PATENT DOCUMENTS

| | | | |
|---|---|---|---|
| 978,957 | 4/1951 | France | 338/242 |
| 496,650 | 12/1938 | United Kingdom | 338/238 |
| 950,648 | 2/1964 | United Kingdom | 338/238 |
| 1,016,397 | 1/1966 | United Kingdom | 338/238 |

*Primary Examiner*—J. V. Truhe
*Assistant Examiner*—M. Paschall
*Attorney, Agent, or Firm*—Craig & Antonelli

[57] ABSTRACT

A bilateral heater unit including an elongated sheath in the form of two substantially parallel adjacent leg portions interconnected by a return bend portion formed of the elongated sheath bent back upon itself and integral with the adjacent parallel extending leg portions. Each of the leg portions is provided with a terminal portion extending outwardly from the end of the leg portion and spaced from the sheath. A resistor assembly is secured between the terminal of each of the leg portions and extends along the sheath between the terminals, the sheath between the terminals being filled with compacted powder insulation spacing the resistor assembly from the sheath. The parallel extending leg portions have opposing inner surfaces thereof spaced from one another and the resistor assembly may include at least one electrically conductive member extending within the sheath along the portion thereof for producing a non-heat generating zone thereat.

25 Claims, 11 Drawing Figures

BILATERAL HEATER UNIT

This is a continuation-in-part application of my co-pending applications Ser. Nos. 382,295 filed July 25, 1973 now U.S. Pat. No. 3,982,099, and 513,140 filed Oct. 8, 1974.

The present invention relates to a cartridge type heater of bilateral construction as disclosed in my co-pending application Ser. No. 382,295 filed July 25, 1973, now U.S. Pat. No. 3,982,099, of which the present invention may utilize at least a portion of the method and construction disclosed therein, the subject matter of my co-pending application being incorporated herein by reference with the present invention being directed to an apparatus for providing improved heating conductivity to the surroundings and/or controlling heating at selected portions of the bilateral cartridge heater. Additionally, the present invention may utilize a bilateral cartridge heater with an indentation as disclosed in my co-pending application Ser. No. 513,140 filed Oct. 8, 1974, the subject matter of which is incorporated by reference herein.

My co-pending application Ser. No. 382,295 now U.S. Pat. No. 3,982,099, discloses a heater unit of bilateral construction which is formed by forming a resistor assembly of a resistor helix extending between terminals and overlapping the same, inserting the assembly in a sheath tube, filling the tube with insulating powder, placing end plugs over the terminals, bending the tube into a U-shape, pressing the legs of the U together and feeding the pressed unit through swaging dies or the like to deform the tube over the length thereof so as to provide a heater unit of an elongated member bent over upon itself. The resultant construction of such a heater unit provides two interconnected substantially parallel leg portions of substantially semicircular cross section and a return bend portion having a part which is substantially circular in cross section with the resultant cross section of the heater unit being substantially circular and the terminals being at the same end of the heater unit.

It has been found that in some applications it is desirable to provide selective heating portions along the length of the bilateral heater. For example, when the heater is inserted into a hole of a member, in some instances, the bend area of the heater is out of contact with the walls forming the hole and would not be adequately heat-sinked. Consequently, this area of the heater may overheat causing heater failure. Additionally, the bend area may be entirely outside of a heat-sink area or it may be desirable to create zones along the length of the heater which do not serve as heat generating areas or present an area having substantially reduced temperatures with respect to other adjacent areas.

Accordingly, it is an object of the present invention to provide a heater unit of bilateral construction with at least one selected area arranged to provide substantially reduced temperatures with respect to adjacent heater temperatures.

In accordance with the present invention, the resistor assembly which is spaced from the surrounding elongated sheath by powdered or granulated insulating material and extends between the end terminals of the bilateral heater includes at least one resistor member, generally of helical form, and may include a conductive member which does not serve as a heat generating portion thereby providing a cold zone type area in the region of its extension within the heater unit.

In accordance with another feature of the present invention, the conductive member may be in the form of a tube, solid rod, or standard wire bundle disposed at at least one selected portion of the heater unit, for example, in the bend area and secured between two resistor portions or members. Additionally, the conductive member may be secured between an end terminal and a resistor member within the heater unit and may be an integral portion of the terminal.

In accordance with the present invention, the resistor member which is generally of a helical form is placed about the conductive member and is disclosed in the co-pending application Ser. No. 382,295, upon subsequent deformation, the resistor member is pressed into the surface of the conductive member causing indentations therein and a secure mechanical and electrical connection therewith.

According to another feature of the present invention, in order to provide improved heat conductivity into the surroundings and/or additional control over the heating effects at selected portions of the heater unit, the legs of the heater are spaced from one another in contradistinction to the structural arrangement disclosed in my co-pending application Ser. No. 382,295 wherein the legs of the heater were closely adjacent one another. The spacing may be effected by placing a deforming tool or member of appropriate shape between the legs of the U-shaped unit prior to the deformation step as disclosed in the co-pending application whereby the inner heater legs take the shape of the deforming member which is subsequently removed. The inner heater legs may, for example, be concave, convex or V-shaped in accordance with the shape of the deforming tool. Additionally, a member may be installed in the gap between such legs to bias the legs into good conductive relation with the member to be heated and/or to help restrict heat flow and may be an asbestos cloth or flattened asbestos sleeving, for example.

These and further objects, features and advantages of the present invention will become more apparent from the following description when taken in connection with the accompanying drawings which show, for purposes of illustration only, several embodiments in accordance with the present invention, and wherein.

Figure 3A:
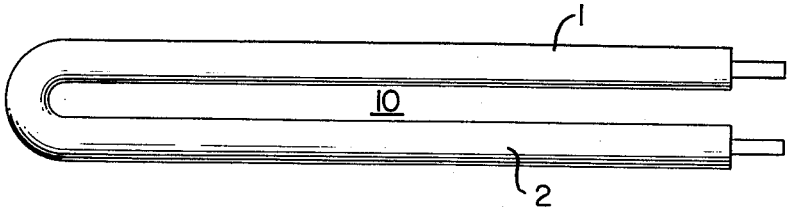
Figure 3B:
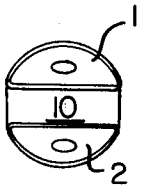
Figure 4A:
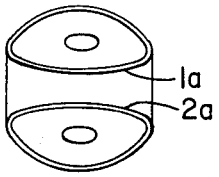
Figure 4B:
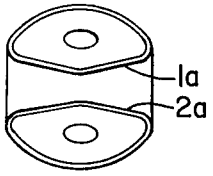
Figure 5A:
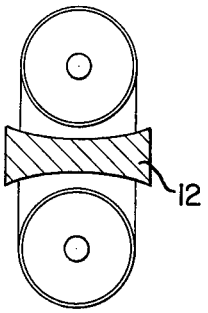
Figure 5B:
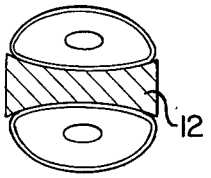
Figure 5C:
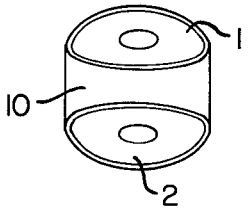
Figure 6:
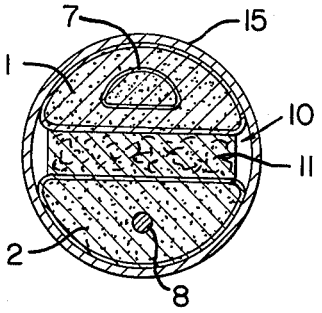
Figure 7:
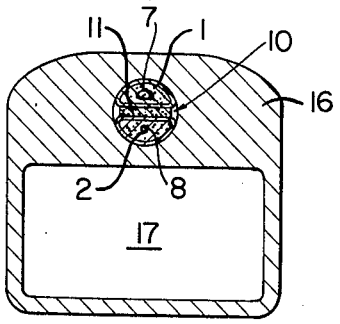

FIGS. 3*a*–3*b* are respectively side and end views of a bilateral heater unit having a gap between the leg portions in accordance with the present invention;

FIGS. 4*a* and 4*b* illustrate end views of different inner heater leg constructions;

FIGS. 5*a*–5*c* illustrate the manner in which a gap between the heater legs is formed in accordance with the present invention with the inner heater legs taking the shape of the deforming tool;

FIG. 6 is a cross-sectional view of a bilateral heater unit with a gap between the legs filled with an insulating member arranged within a tube wall of a member to be heated; and FIG. 7 is a cross-sectional view of a bilateral heater unit in a tube wall of a member to be heated having a hollow portion therein.

Figure 1:
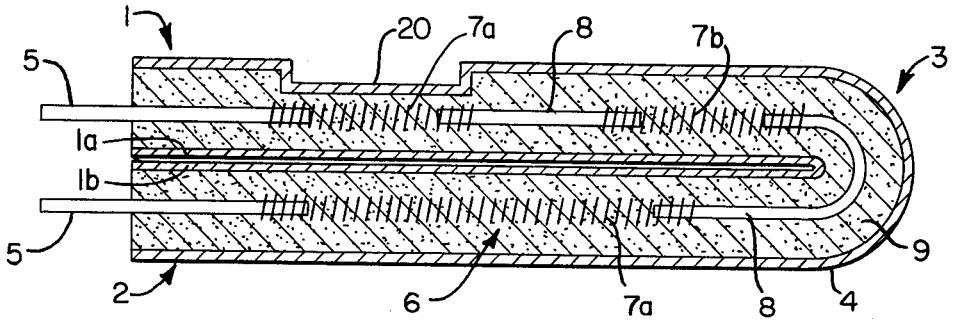
FIG. 1 is a cross-sectional view of a bilateral heater unit constructed in accordance with the present invention.

Referring now to the drawings wherein like reference numerals are used to designate like parts throughout the several views, there is shown in FIG. 1 a cross-sectional view of a bilateral heater unit in accordance with the present invention wherein the heater unit has two substantially parallel adjacent leg portions 1 and 2 interconnected by a return bend portion 3 formed of an elongated metallic sheath 4 bent back upon itself. Each of the leg portions is provided with a terminal member 5 extending outwardly from the adjacent end portion and spaced from the sheath. A resistor assembly 6 including at least one resistor helix portion 7 and at least one conductive interconnecting member 8 is secured between the terminals 5 and extending along the sheath between such terminals. The sheath between the terminals is completely filled with compacted powder insulation 9 such as MgO powder spacing the resistor assembly from the sheath 4. The legs of the heater unit are noncircular in cross-section with the outer portions being arcuate in shape and circumscribing substantial portions of a circle corresponding to a diameter opening into which the heater is adapted to be inserted with close fit.

The conductive member 8 may be a cylindrical member in the form of a ductile hollow tube, a ductile hollow rod or a ductile bundle of stranded wire and preferably consists of a high temperature tolerating metal such as stainless steel type 304. The at least one interconnecting conductive member 8 serves to prevent the generation of heat at desired selected areas of the heater unit such as the return bend portion 3 of the heater. In this manner, the bend area which may be outside the heat-sink area or may not be adequately heat-sinked due to the fact that the bend portion 3 is out of contact with the walls of the member in which the heater is inserted and thereby may be overheated resulting in heater failure is avoided. The conductive member 8 provides a conductive path thereby eliminating the heat-generating resistor 7 in the areas thereof so that no heat is generated in such areas. The conductive member may be of varying length in order to create greater or lesser cold zones (non-heat generating areas) along the length of the heater.

As shown in FIG. 1, the conductive members 8 may be located in either leg of the heater to create cold zones and may extend along the return bend portion of varying lengths in the heater legs in accordance with the desired requirements. Moreover, the conductive member 8 may extend along the entire length of a heater leg so as to form a cold heater leg with the conductive member 8 forming a part of the terminal 5 extending outwardly from such heater leg. Additionally, the leg 1 may be provided with an indentation 20 as disclosed in my co-pending application Ser. No. 513,140.

Figure 2:
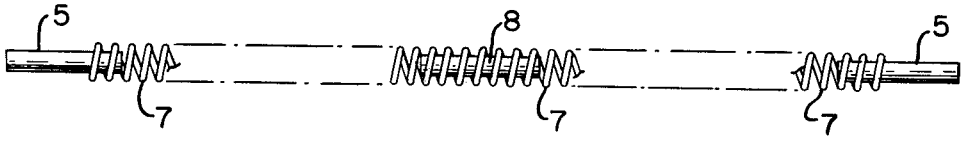
FIG. 2 illustrates one form of resistor and conductor assembly in accordance with the present invention.

FIG. 2 illustrates another form of a resistor assembly wherein an interconnecting conductive member 8 is disposed within the coils of the resistor helix 7 whereupon subsequent deformation in the manner disclosed in my co-pending application Ser. No. 382,295 presses the resistor wrap into the surface of the conductive member as well as that of the terminal means so as to create indentations in the conductive member 8 and terminal means and to provide a secure electrical and mechanical connection therewith. Since the conductive member 8 provides an electrical shorting path in this area of the heat generating resistor 7, a cold zone area is produced. Alternatively, as disclosed in FIG. 1, the resistor member 7 may be formed of separate resistive portions **7*a*, 7*b* connected to the conductive member 8 whereby again a cold zone is provided in the region of the conductive member 8. The length of the interconnecting conductive member 8** may for example be twice the final cartridge diameter depending upon the desired cold zone area whereby for example a $\frac{3}{8}$ inch diameter cartridge would be assembled with a $\frac{3}{4}$ inch interconnecting conductive member.

Another manner of controlling the heat application of selective portions of the heater unit is by providing a gap or spacing 10 between the substantially parallel heater legs 1 and 2 as illustrated in FIGS. **3*a* and 3*b* of the drawings. In this manner, excessive heating of the leg portions due to heat transfer between the adjacent inner leg portions is retarded in that the gap 10 prevents conduction by contact and retards the radiant flow of heat therebetween. Additionally, an insulating member 11 as shown for example in FIG. 6 may be disposed in the gap 10** to help restrict heat flow with such member being formed of for example asbestos cloth or flattened asbestos sleeving. The gap may be on the order of 1/16 inch to $\frac{3}{8}$ inch for example.

As shown in FIGS. **4*a* and 4*b*, due to the provision of the gap between the parallel leg portions, the facing portions 1*a* and 2*a* of the heater legs may take any desired shape, with a nonplanar, curved or radiused inner leg portion being illustrated in FIG. 5 and a non-planar V-shaped inner leg portion being illustrated in FIG. 4*b*. As shown in FIG. 3*b*, the inner leg portions 1*a* and 2*a* may also be provided with planar, flat opposing surfaces. Moreover, since the gap 10** is provided between the parallel legs, the return bend portion may have an approximate inner radius of, for example, 1/32 inch or 3/16 inch.

Additionally, since a gap is provided, the legs 1 and 2 of the heater no longer form substantially individual halves of a circle as in my co-pending application Ser. No. 382,295.

The manner in which the gap 10 is formed is illustrated in FIGS. **5*a*–5*c* wherein a spacing or deformation tool 12 is placed between the U-shaped structure formed, in the manner disclosed in my co-pending application Ser. No. 382,295, prior to the pressing of the legs together and the deformation thereof. As shown, the deformation or spacing tool 12 is provided with a desired shape on opposite surfaces 13 and 14 thereof to which the inner heater leg surfaces 1*a* and 2*a* conform during the deformation step. After completion of the deformation, the deforming or spacing tool 12 is removed with the resultant surface configuration of the heater legs being as illustrated in FIG. 5*c***.

FIG. 6 illustrates an arrangement of the bilateral heater unit of the present invention disposed in a tube wall 15 of a hot-melt adhesive device for example. As shown, the legs of the heater unit are noncircular in cross-section with the arcuate outer portions of the legs circumscribing substantial portions of a circle corresponding to the diameter of the tube 15 so that the heater fits within the tube 15 with a close fit. In accordance with the present invention, the heater unit permits selective application of heat to parts to be heated, i.e., a slug of hot melt adhesive. By limiting the resistor portion to the upper leg 1 of the heater and utilizing a conductive member 8 in the entire lower leg 2 and the bend portion 3 so as to provide a cold zone or non-heat generating zone thereat, only the upper surface of the tube 15 is heated by the heater unit. The gap 10 between the legs prevents or retards the flow of heat to the lower leg and the lower part of the tube. Further, the insulating member 11 is provided in the gap to help restrict heat flow. The advantage of such an arrangement is that overheating of the tube 15 at its lower surface is prevented. That is, since in prior art arrangements, the lower surface of the tube would not have its heat drawn away as quickly as would the top surface due to the heat flow into the hot melt adhesive, it would generally become hotter than the top surface if both the top and bottom surfaces were equally heated. Where a slug of hot melt adhesive is being melted, the melting slug thus causes a lower temperature at the top of the tube and as the melted adhesive runs around the tube 15, it tends to drip off thereby bypassing the lower surface. Excessive heat then builds up on the lower surface and that portion of melted adhesive which runs around to the bottom of the tube wall and comes into contact with this excessive temperature may become degraded by excessive heat and/or be burned or charred by this heat. As such, a fire hazard due to the excessive temperature may result or the charred adhesive may fall from the tube and contaminate that melted adhesive which was not charred. However, the contamination or fire hazard is avoided by the present invention which provides control of the heating at various portions of the heater unit in that the cold leg 2 of the heater illustrated in FIG. 6 does not heat the hot melt adhesive.

It should be noted that due to the provision of the gap 10 between the legs, there results a springiness in the leg portions such that the leg portions are in effect biased into good conducting relation with the tube wall of appropriate diameter into which the heater unit is inserted so as to provide for an improved heat conductivity with the tube wall. Further, a member may be inserted in the gap to further bias the legs outwardly into good conducting relationship. On the other hand, cartridge units of prior construction generally do not provide a close fit within the tube wall of the member to be heated such that the heater necessarily lies at the bottom portion of the tube wall with an air space between the top of the heater unit and the top portion of the tube wall to be heated, for example, in the case of a hot-melt adhesive heater device. Thus, even if the cartridge heater is provided with a lower non-heat generating zone, due to the constructional arrangement, heat is more easily transferred from the heat generating zones into the non-heat generating zones than through the air space between the top surface of the heater and the tube wall resulting in a small heat differential between the zones. However, the present invention due to the utilization of the gap and aforedescribed features serves for preventing such heat transfer. Moreover, as shown in FIG. 7, a further improved cooling effect can be achieved by utilizing a tube wall member 16 having a lower hollow portion 17 adjacent the cold zone portion 2 of the heater unit so as to provide for improved cooling and a maintenance of a desired heat differential.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A bilateral heater unit comprising an elongated sheath in the form of two substantially parallel adjacent leg portions interconnected by a return bend portion formed of said elongated sheath bent back upon itself and being integral with the adjacent parallel extending leg portions, said leg portions being noncircular in cross-section and having arcuate outer portions circumscribing substantial portions of a circle, each of said leg portions having terminal means extending outwardly from the adjacent end portion thereof and spaced from said sheath, resistor assembly means secured between said terminal means of each of said leg portions and extending along the sheath between said terminal means, said sheath between said terminal means being filled with compacted powder insulation spacing said resistor assembly means from said sheath, said resistor assembly means including resistive heating means and at least one electrically conductive member extending within said sheath along a portion thereof between said terminal means, said at least one electrically conductive member having a length sufficient for producing a non-heat generating zone thereat.

2. A bilateral heater unit according to claim 1, wherein said at least one electrically conductive member extends from one of said terminal means so as to provide a non-heat generating zone from said terminal means along at least a portion of said one parallel leg portion.

3. A bilateral heater unit according to claim 1, wherein said non-heating generating zone is provided in the region of said return bend portion.

4. A bilateral heater unit according to claim 1, wherein said parallel adjacent leg portions have opposing inner surfaces thereof spaced from one another.

5. A bilateral heater unit according to claim 3, further comprising insulating means disposed within the spacing between said opposing inner surfaces of said adjacent leg portions.

6. A bilateral heater unit according to claim 4, wherein said opposing inner surfaces of said spaced parallel adjacent leg portions have one of a planar and non-planar configuration.

7. A bilateral heater unit according to claim 6, wherein said non-planar configuration includes at least one of a curved and a V-shaped configuration.

8. A bilateral heater unit according to claim 1, wherein said elongated sheath is provided with indentation means therein.

9. A bilateral heater unit according to claim 8, wherein said indentation means includes a groove.

10. A bilateral heater unit according to claim 1, further comprising a member to be heated having an opening in which said bilateral heater unit is inserted, said member having a hollow portion adjacent the opening thereof, said bilateral heater unit being disposed in said opening with said non-heat generating zone thereof proximate to said hollow portion of said member.

11. A bilateral heater unit comprising an elongated sheath in the form of two substantially parallel adjacent leg portions interconnected by a return bend portion formed of said elongated sheath bent back upon itself and being integral with the adjacent parallel extending leg portions, said return bend portion including a part having a substantially circular cross section, said leg portions being non-circular in cross section and having arcuate outer portions circumscribing substantial portions of a circle, said leg portions having opposing inner surfaces thereof spaced from one another, each of said leg portions having terminal means extending outwardly from the adjacent end portion thereof and spaced from said sheath, resistor assembly means secured between said terminal means of each of said leg portions and extending along the sheath between said terminal means, said sheath between said terminal means being filled with compacted powder insulation spacing said resistor assembly means from said sheath.

12. A bilateral heater unit according to claim 11, further comprising means disposed within the spacing between said opposing inner surfaces of said adjacent leg portions.

13. A bilateral heater unit according to claim 12, wherein said means disposed within the spacing includes an insulating means.

14. A bilateral heater unit according to claim 11, wherein said opposing inner surfaces of said spaced parallel adjacent leg portions have one of a planar and non-planar configuration.

15. A bilateral heater unit according to claim 11, wherein said non-planar configuration includes at least one of curved and V-shaped configurations.

16. A bilateral heater unit according to claim 11, further comprising a member to be heated having an opening in which said bilateral heater unit is disposed, and means inserted between the spaced parallel adjacent leg portions for biasing said leg portions into good heat conductive heat relationship with said member to be heated.

17. A bilateral heater unit according to claim 11, further comprising a member to be heated having an opening in which said bilateral heater unit is inserted, said member having a hollow portion adjacent the opening thereof, said bilateral heater unit being disposed in said opening with one of said leg portions proximate to said hollow portion of said member.

18. A bilateral heater unit according to claim 11, wherein said resistor assembly means includes resistive heating means and at least one electrically conductive member extending within said sheath along the portion thereof between said terminal means, said at least one electrically conductive member having a length sufficient for producing a non-heat generating zone thereat.

19. A bilateral heater unit according to claim 18, wherein said at least one electrically conductive member extends from one of said terminal means so as to provide a non-heat generating zone from terminal means along at least a portion of said one parallel leg portion.

20. A bilateral heater unit according to claim 18, wherein said non-heat generating zone is provided in the region of said return bend portion.

21. A bilateral heater unit according to claim 1, wherein said return bend portion includes a part having a substantially circular cross section.

22. A bilateral heater unit according to claim 2, wherein said electrically conductive member for providing a non-heat generating zone is integral with said terminal means.

23. A bilateral heater unit according to claim 2, wherein said electrically conductive member for providing a non-heat generating zone extends along at least the entire length of said one parallel leg portion.

24. A bilateral heater unit according to claim 19, wherein said electrically conductive member for providing a non-heat generating zone is integral with said terminal means.

25. A bilateral heater unit according to claim 19, wherein said electrically conductive member for providing a non-heat generating zone extends along at least the entire length of said one parallel leg portion.

* * * * *